US005525966A

United States Patent [19]

Parish

[11] Patent Number: 5,525,966

[45] Date of Patent: Jun. 11, 1996

[54] ELECTRONIC SECURITY SYSTEM FOR WEAPONS

[75] Inventor: Lane Parish, Montgomery, Tex.

[73] Assignee: Eagle Electronics Inc., Montgomery, Tex.

[21] Appl. No.: 517,797

[22] Filed: Aug. 22, 1995

[51] Int. Cl.[6] ..... G08B 13/14

[52] U.S. Cl. ..... 340/568; 224/243; 340/539; 340/571; 340/693

[58] Field of Search ..... 340/568, 571, 340/539, 693; 224/243, 238, 911, 912

[56] References Cited

U.S. PATENT DOCUMENTS

| | | | |
|---|---|---|---|
| 3,440,635 | 4/1969 | Hull | 340/539 |
| 3,530,451 | 9/1970 | Devine | 340/539 |
| 3,611,333 | 10/1971 | Conigliaro | 340/569 |
| 3,868,573 | 2/1975 | Holcomb et al. | 455/89 |
| 4,284,985 | 8/1981 | Heger et al. | 340/572 |
| 4,541,191 | 9/1985 | Morris et al. | 42/1.01 |
| 4,591,836 | 5/1986 | Feingenblatt, Jr. et al. | 340/574 |
| 4,603,327 | 7/1986 | Leonard et al. | 340/573 |
| 4,768,021 | 8/1988 | Ferraro | 340/543 |
| 4,843,336 | 6/1989 | Kuo | 340/521 |
| 4,936,037 | 6/1990 | Holcomb et al. | 42/106 |
| 5,001,460 | 3/1991 | Basson | 340/571 |
| 5,053,750 | 10/1991 | Alex | 340/568 |
| 5,108,019 | 4/1992 | Woodward et al. | 224/243 |
| 5,196,827 | 3/1993 | Allen et al. | 340/568 |
| 5,239,305 | 8/1993 | Murphy et al. | 340/539 |
| 5,479,149 | 12/1995 | Pike | 340/568 |

*Primary Examiner*—Glen Swann

*Attorney, Agent, or Firm*—Pravel, Hewitt, Kimball & Krieger

[57] ABSTRACT

A security system including an electronic alarm signal transmitting circuit is mounted with a holster or other weapons carrier or storage container. The system includes a switch beneath a strap or cover on the holster. The switch senses when an attempt is made to open the holster strap for access to the weapon, and activates the alarm circuit. Alarms can be sent to a home alarm system, central monitor station or other monitor.

20 Claims, 3 Drawing Sheets

ELECTRONIC SECURITY SYSTEM FOR WEAPONS

BACKGROUND OF INVENTION

1. Field of Invention

The present invention relates to electronic security/monitor systems for firearms.

2. Description of Prior Art

It is not uncommon for individuals to have weapons or firearms in their residences or other locations for security or protective purposes. For such a purpose, the weapon must be reasonably quickly available for use for its intended purpose. However, if there are children or other people who might have unauthorized access to the weapon, safety has been a very important concern. There are thus two competing and often contradictory considerations which must be taken into account.

One approach, such as in U.S. Pat. No. 5,108,019 is to provide an audible alarm on the holster or storage receptacle. The alarm is activated if an attempt is made to open the holster to remove the weapon. However, at times it might be necessary for safety or protective reasons, such as an intruder in one's dwelling, to unholster the weapon. In such a case, the alarm could give away the location of the weapon and the person attempting to use it. A key-operated lock-out switch could be provided as an attempted protective feature against this, but keeping track of the key was a problem. Keys can and are often lost or misplaced. If the key were kept with the weapon, the protective feature could be easily defeated by an unauthorized user. If the key were kept separated form the weapon and a need arose to unholster the weapon, the alarm gave away the weapon holder's location.

The other approach was to provide relatively unhindered access to the weapon for use when needed, notifying a central location when the weapon was unholstered. U.S. Pat. No. 3,530,451 was an example of such an approach, usually intended for situations where the person with access to the weapon was an experienced gun handler, such as a law enforcement officer or security guard. In this type of alarm, an indication was sent by radio to a central office or location when the weapon was unholstered. However, since the intended user of such an alarm system was an experienced gun handler, no provision was made to restrict physical removal of the weapon from the holster. Typically, the activating mechanism for the alarm was located in a manner to either facilitate or at least not hinder weapon removal. In effect, there was no suitable provision for protection against unauthorized weapon removal. Additionally, the need for an ability to easily remove the weapon in emergency or dangerous situations made it apparently inadvisable to otherwise impede removal of the weapon from the holster.

SUMMARY OF INVENTION

Briefly, the present invention provides a new and improved security system for indicating attempted removal of a weapon, such as a handgun, from a storage container or holster which has a weapon retainer mechanism or strap on it. A switch is provided to sense movement of the weapon retainer. A transmitter which is responsive to the switch sends a signal indicating operation of the switch and thereby indicates attempted removal of the weapon.

The transmitter is located in a transmitter housing which is mounted on the storage container or holster. The switch is mounted between the storage container and the retainer mechanism or strap so that movement of the retainer mechanism to attempt access to the weapon is sensed. The transmitter housing has an attachment belt which is fittable onto the storage container or holster. In this way, movement of the retainer mechanism sensed by the switch activates the transmitter to notify the owner of the weapon or some other interested party of attempted removal of the weapon for possible unauthorized use.

The signal is sent as electromagnetic energy, so that it is not perceptible until received at a monitoring receiver. Thus, the alarm does not alert some unauthorized person of the weapon's location.

DESCRIPTION OF THE PREFERRED EMBODIMENT

Figure 2:
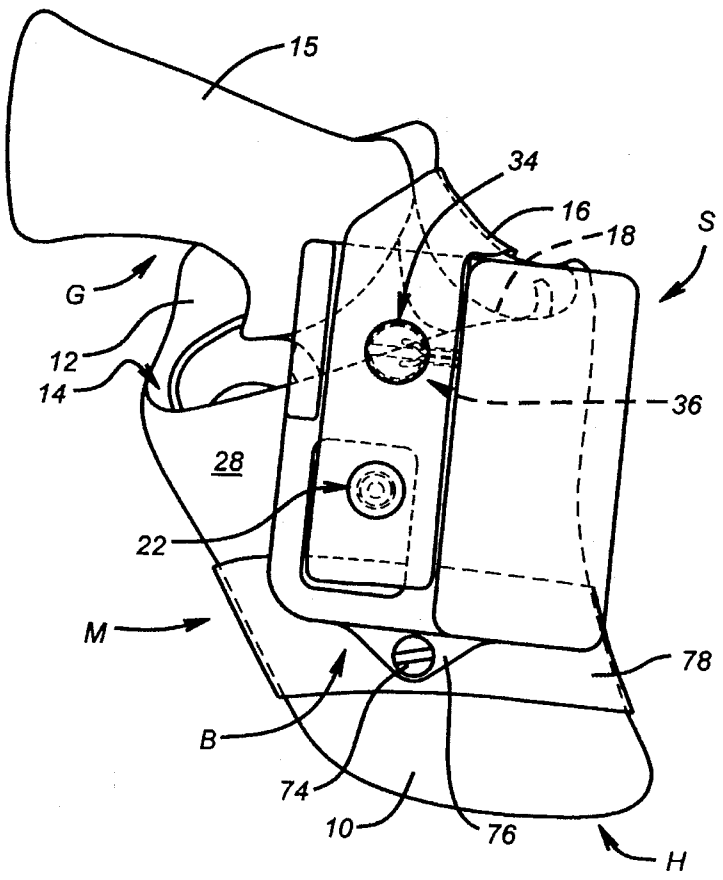
FIGS. 1 and 2 are elevation views of a weapon security system according to the present invention on a pistol holster.

In the drawings, the letter S designates generally a security system for indicating attempted removal of a weapon, in the preferred embodiment a handgun G, from a weapon storage container such as holster H. As is conventional, the holster H has a weapon retainer mechanism or strap P associated with it. The storage system S includes a switch W which senses movement of the strap P for access to the weapon G in the holster H. The security system S also includes a transmitter T (FIG. 7) which responds to the switch W to send an alarm signal indicating attempted removal of the weapon G from the holster H. A mounting mechanism M is provided to attach the transmitter T to the holster H.

The weapon which in the preferred embodiment is a handgun G may be a revolver, an automatic pistol type or a handgun of any other suitable type, and is thus conventional. The holster H is also of any suitably available type adapted to receive the particular handgun G to be stored therein for storage or for carrying. As will be set forth, the security system S and its transmitter T, due to the mounting mechanism M, permit use with any of several different holsters and thus are not limited for use to a particular type of specialized holster. The security system S thus need not be discarded along with the holster in the event that the holster becomes damaged. Also, the security system S may be transferred to a different weapon and holster as safety needs require.

The holster H with which the security system S is used includes an outer or front half 10 integrally formed to otherwise suitably attached to each other to define a pouch 14 into which the handgun G is fitted for storage. Typically a grip 15 and other rear portions of the handgun G extend outwardly so that the handgun can be gripped and removed. The weapon retaining strap P is mounted at a rear portion in a conventional manner to a backside of the rear half 12 of the holster H. The strap P is adapted to fold over rear portions over the handgun and hold it firmly in place to prevent its removal from the holster H.

The strap P includes an intermediate portion 16 extending forwardly out and over an open upper end 14*a* of the pouch 14. The intermediate portion 16 of the strap P is adapted to pass over the pouch 14 and enclose the handgun G in the holster H. Depending upon the type of handgun G, the intermediate portion 16 of the strap P may also restrict movement of a hammer 18 of the handgun G in appropriate cases to thereby prevent inadvertent firing of the gun while in the holster H.

A conventional fastener snap 20 of a strap closure connector or fastener mechanism 22 is mounted at a forward portion 24 of the strap P. The fastener snap 20 is adapted to engage a mating fastener snap 26 located at a suitable position on an outer face 28 of the front half 10 of the holster H. It should be understood that other known types of fastener mechanisms than snaps may also be used, if desired.

Figure 7:
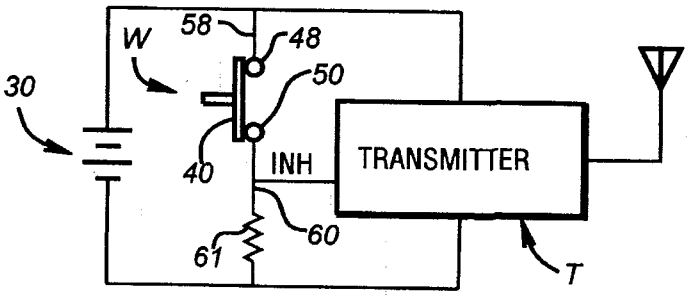
FIG. 7 is a schematic electrical circuit diagram of the security system of the invention.

Considering now the safety system S of the present invention more in detail, the transmitter T is a miniaturized emitter, as indicated, of electromagnetic energy waves. A suitable such transmitter might be, for example, a Model WT-100A or Model WT-100 wireless transmitter available from Visonics Ltd. (U.S.A.) of Bloomfield, Conn. The transmitter T is mounted in a base plate B attached to the holster H by the mounting mechanism M. The transmitter T may be of any suitable miniaturized configuration which is capable of being powered by a miniaturized dry-cell battery 30 (FIG. 7). The transmitter T is electrically connected to the switch W so that when the switch W is opened, the transmitter T sends electromagnetic energy, usually radio waves, to a monitor. The monitor may be, for example, a home security alarm system, a centralized security monitoring service, or a portable radio receiver which can be carded by the handgun owner. The monitor may also be kept in a separate portion of a residence or dwelling where the security system S is to be used from the handgun G.

The switch W includes a first switch portion 34 mounted with the strap P inwardly from the fastener strap 20 and a second switch portion 36. The switch W is adapted to permit electrical current to flow from the battery 30 to activate the transmitter T when the switch portions 34 and 36 are moved relative to each other, such as by an attempt to unfasten the holster strap P.

In the preferred embodiment, the switch W is an electrical switch, although it should be understood that other conventional types of switches which permit electrical current to flow in an electrical circuit upon relative movement of the switch components may be substituted as well. For example, the switch W can take the form of a magnetic switch, a microswitch, or a reed switch, as well as any other type of conventional, known switches.

Figure 1:
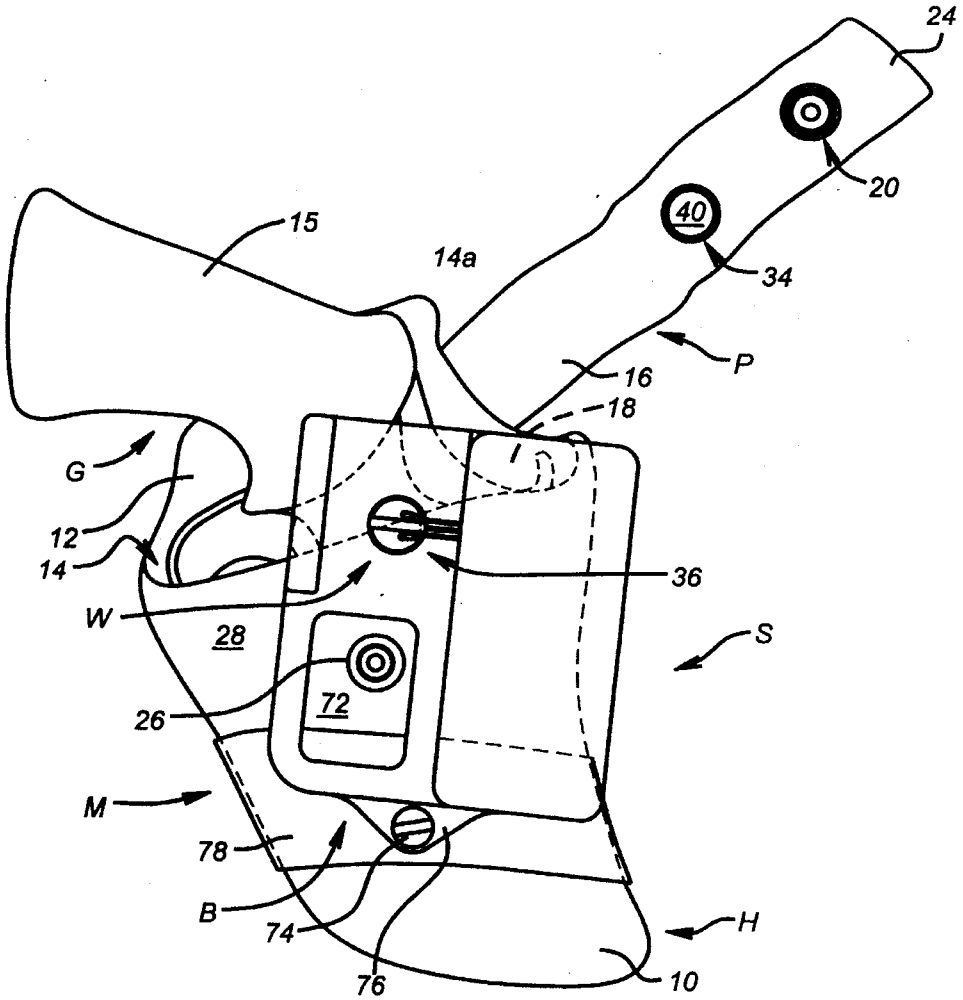
Figure 3:
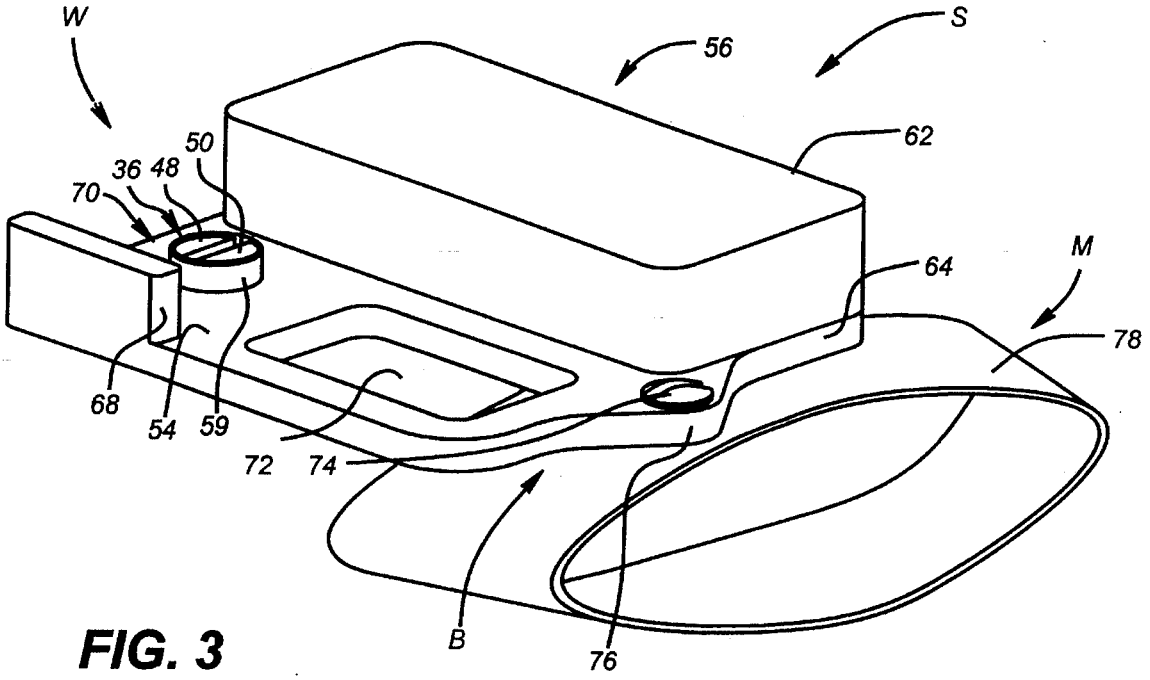
FIG. 3 is an isometric view of the security system of FIGS. 1 and 2.
Figure 4:
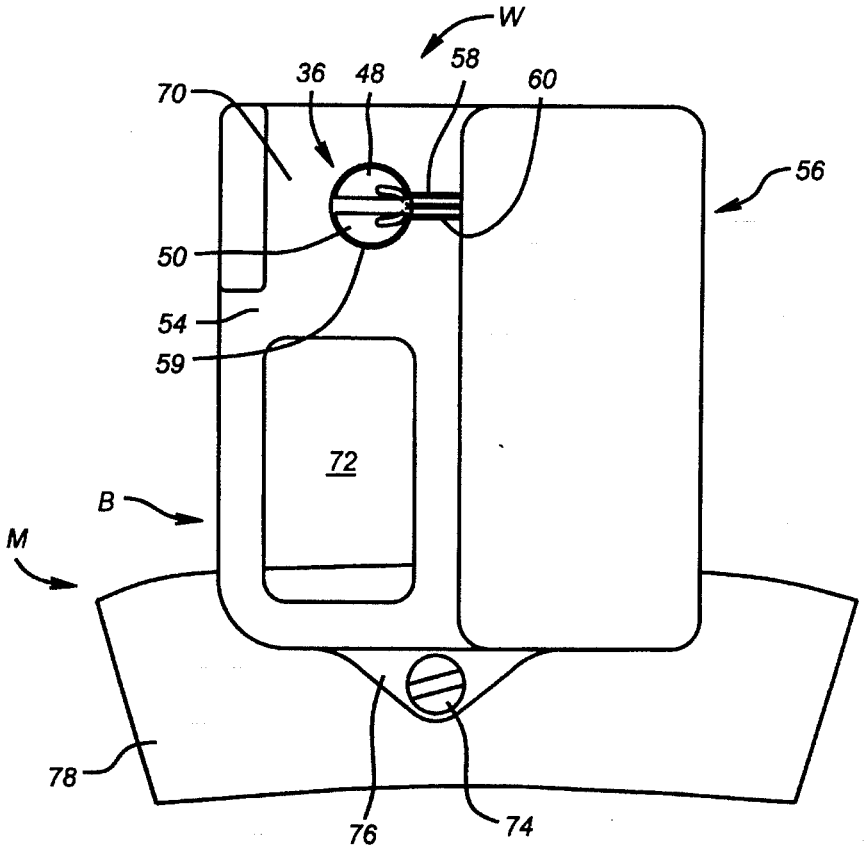
FIG. 4 is plan view of the security system of FIG. 3.
Figure 5:
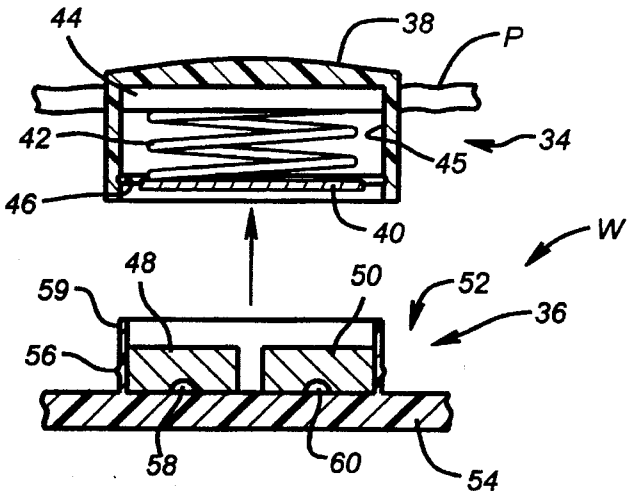
FIG. 5 and 6 are elevation views, taken partly in cross-section of a portion of the structure of FIGS. 3 and 4.

The first switch portion 34 of the switch W includes a housing chamber 38 mounted with the holster strap P (FIG. 5) spaced from the fastener snap 20 (FIG. 1). A contact plate or disk 40 (FIG. 5) is mounted in a lower portion of the chamber 38 and is resiliently urged outwardly by a spring 42 mounted between the contact disk 40 and a rear support member 44. The contact disk 40 is thus movable within chamber 38 according to the relative forces exerted on it. An annular mounting groove or slot 46 is formed in the inner wall 45 in the housing 38 of the first switch portion 34.

The second switch portion 36 of the switch W includes spaced electrical contacts or conductive members 48 and 50 which are mounted spaced and out of electrical contact with each other within a contact housing 52. The contact housing 52 is formed extending upwardly from a mounting surface 54 of a transmitter housing or cover 56 of the transmitter base plate B.

The contact housing 52 extends upwardly from the mounting surface 54 and is adapted to fit within the chamber 38 of the first switch portion 34 of the switch W. A beaded or otherwise outwardly extending surface 56 is formed on an outer wall 59 of the member 52 and is adapted to be snap-fitted into the groove 46 within the chamber 38. In this manner, the first switch portion 34 and second switch portion 36 are firmly connected together, urging the contact member 40 firmly into mechanical contact with the spaced conductive members 48 and 50 and completing an electrical circuit between them. The conductive members 40 and 50 of the second switch portion 36 are connected by conductors 58 and 60, respectively, in the electrical circuit (FIG. 7) with the transmitter T.

The transmitter T is connected to the switch W so that it emits a signal when the switch W is opened. For example, the transmitter T may be connected at an inhibit or INH terminal to the conductor 60 and a resistor 61. When the switch W is in its normally closed position, the transmitter T is prevented from sending signals. When, however, the switch W is opened, the transmitter T begins sending an alarm signal, either as a single alarm or a repetitive signal. It should be understood that the other transmitter circuits than the one illustrated in FIG. 7 can be used, as well.

The transmitter T and the battery 30 are mounted in the transmitter housing 56 on the base plate B within a cover 62. The cover 62 is mounted adjacent the mounting surface 54 of the transmitter housing 56. The cover 62 is removably mounted on the base plate B by suitably located screws or other fastener mechanisms so that the battery 30 may be periodically replaced as needed. Both the base plate B and cover 62 of transmitter housing 56 are preferably formed from a suitable synthetic resin.

The base plate B has an upwardly extending side retainer member or guide rail 68 formed thereon adjacent the second switch portion 36, defining a channel 70 into which the strap P is fitted and confined when the fastener 22 is closed by fitting the fastener snaps 20 and 26 together. The member 68 serves as a barrier against sideward or rotational movement of the strap P in channel 70 on the base plate B.

An access port 72 is formed in the mounting surface 54 of the to provide access for the fastener snaps 20 and 26 to each other so that the end of strap P may be connected to the holster H. The base plate B is pivotally mounted at a connector tab 76 by a screw or stud 74 to an attachment belt or strap 78 of the mounting mechanism M. The attachment belt 78 is adapted to be fitted onto the holster H at a location where the fastener snap 26 is accessible through the access port 72 of the base plate B. Typically, the attachment belt 78 is formed of a suitable elastic or expandable material so that a firm fitting grip is provided by the mounting mechanism M of the security system S on the holster H.

Figure 6:
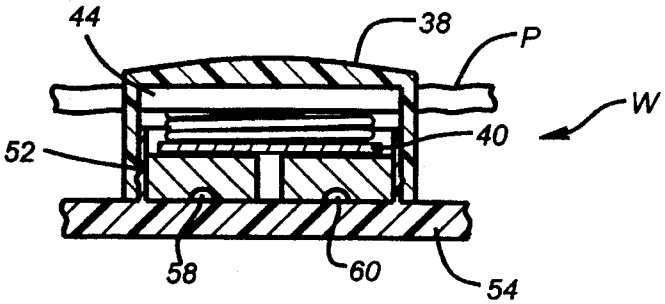

In the operation of the present invention, the handgun G is placed in the holster H and the snap fastener 22, as well as the switch W (FIG. 6), firmly closed. The monitoring station is then alerted or activated to indicate that the security system S has been activated. Thereafter, in the event that someone should move the strap P in an attempt to remove the handgun G from the holster H to any extent such that the switch W is opened (FIG. 5), the transmitter T is activated and begins transmission of electromagnetic energy waves to the monitoring station or stations. It is to be noted that the transmitted signal is sent as electromagnetic energy so it is not perceptible until received at the monitoring station. Thus, the signal when sent does not alert some unauthorized person of the weapon's location.

The electromagnetic energy when received at the monitoring receiver forms a prompt alarm, audio or otherwise, to the monitoring person or station that an unauthorized attempt has been made to remove the handgun G from the holster H. Suitable precautionary steps can then be promptly taken.

Having described the invention above, various modifications of the techniques, procedures, material and equipment will be apparent to those in the art. It is intended that all such variations within the scope and spirit of the appended claims be embraced thereby.

I claim:

1. A security system for indicating attempted removal of a weapon from a storage container having a weapon retainer mechanism on it, comprising:

a switch for sensing movement of the weapon retainer mechanism for access to the weapon in the container; and a transmitter responsive to said switch for sending a signal indicating operation of said switch to indicate attempted removal of the weapon from the container.

2. The security system of claim 1, further including:

a mounting mechanism for attaching said transmitter to the container.

3. The security system of claim 2, wherein said mounting mechanism includes:

an attachment belt mounted with the storage container; and a transmitter housing mounted with said attachment belt.

4. The security system of claim 1, wherein:

said switch includes movable portions, including a first switch portion mounted with the weapon retainer mechanism and a second switch portion mounted with the storage container, said first and second switch portions activating said transmitter on relative movement with respect to each other.

5. The security system of claim 1, wherein:

said switch comprises an electrical switch.

6. The security system of claim 1, wherein:

said switch comprises a magnetic switch.

7. The security system of claim 1, wherein:

said switch comprises a microswitch.

8. The security system of claim 1, wherein:

said switch comprises a reed switch.

9. The security system of claim 1, wherein the weapon comprises a handgun.

10. The security system of claim 1, wherein the storage container comprises a holster.

11. The security system of claim 10, wherein the weapon retainer mechanism comprises a holster strap.

12. The security system of claim 1, wherein:

said transmitter sends an electromagnetic energy signal indicating operation of said switch.

13. A security system for attachment to a weapon storage container and weapon retainer mechanism to indicate attempted removal of a weapon from the storage container, comprising:

a switch mounted between the weapon storage container and weapon retainer mechanism to sense movement of the retainer mechanism;

a transmitter housing containing a transmitter responsive to said switch for sending a signal indicating attempted removal of the weapon;

an attachment belt fittable on the weapon storage container and having said transmitter housing mounted therewith.

14. The security system of claim 13, wherein the weapon comprises a handgun.

15. The security system of claim 13, wherein the storage container comprises a holster.

16. The security system of claim 15, wherein the weapon retainer mechanism comprises a holster strap.

17. The security system of claim 16, wherein:

said switch includes movable portions, including a first switch portion mounted with said holster strap and a second switch portion mounted with said transmitter housing, said first and second switch portions on relative movement with respect to each other activating said transmitter.

18. The security system of claim 17, further including:

said transmitter housing having a mounting surface formed therewith for mounting said second switch portion thereon.

19. The security system of claim 18, further including:

a guide member formed on said mounting surface for said holster strap.

20. The security system of claim 18, wherein the weapon retainer mechanism and the storage container have a fastener mechanism associated therewith, and wherein:

said transmitter housing includes a fastener mechanism access port formed in said mounting surface.

* * * * *